US010577897B2

(12) United States Patent
Flores Perez et al.

(10) Patent No.: US 10,577,897 B2
(45) Date of Patent: Mar. 3, 2020

(54) SAND CONTROL SLEEVE

(71) Applicants: Juan Carlos Flores Perez, The Woodlands, TX (US); Rostyslav Dolog, Houston, TX (US)

(72) Inventors: Juan Carlos Flores Perez, The Woodlands, TX (US); Rostyslav Dolog, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 186 days.

(21) Appl. No.: 14/705,582

(22) Filed: May 6, 2015

(65) Prior Publication Data

US 2016/0326851 A1 Nov. 10, 2016

(51) Int. Cl.
*E21B 43/08* (2006.01)
*E21B 43/26* (2006.01)

(52) U.S. Cl.
CPC ..... *E21B 43/086* (2013.01); *E21B 43/26* (2013.01)

(58) Field of Classification Search
CPC ..... E21B 43/02; E21B 43/08; E21B 43/082; E21B 43/086
See application file for complete search history.

(56) References Cited

U.S. PATENT DOCUMENTS 7,318,481 B2 * 1/2008 Richard ..... E21B 43/086 166/227
7,703,520 B2 * 4/2010 Dusterhoft ..... E21B 43/025 166/278
2007/0246213 A1 * 10/2007 Hailey, Jr. ..... E21B 43/08 166/278
2012/0186819 A1 * 7/2012 Dagenais ..... E21B 43/08 166/310
2013/0292117 A1 * 11/2013 Robisson ..... E21B 43/08 166/278
2014/0034324 A1 * 2/2014 Lopez ..... E21B 34/06 166/316

OTHER PUBLICATIONS

Harper, et al., "New technology offers sand control option"; Offshore Magazine, vol. 72, Issue 1, Jan. 15, 2013; 7 pages; http://www.offshore-mag.com/articles/print/volume-73/issue-01/productions-operations/new technology.

* cited by examiner

*Primary Examiner* — Brad Harcourt
(74) *Attorney, Agent, or Firm* — Cantor Colburn LLP

(57) ABSTRACT

A sand control sleeve includes a body; a port extending through the body; and a filtration material disposed relative the port and configured to attain a first condition where relatively less of the port is occupied. A second condition where relatively more of the port is occupied by the material. A method for producing fluid.

16 Claims, 3 Drawing Sheets

SAND CONTROL SLEEVE

BACKGROUND

In the drilling and completion industry, flow and sand control are both important matters for a number of operations. Sometimes flow is for production while at other times flow can be related to a treatment operation like, for example, fracturing. Regardless of the particular operation it is generally the case that flow should be as unimpeded as possible while at the same time avoiding the entrainment of undesirable fluid or solid constituents. Various configurations therefore are used in the art to promote flow while restricting for example sand. Many of these work well but all have drawbacks leaving the industry in constant search for alternative configurations and means to accomplish the above noted goals more efficiently and/or more reliably. Accordingly, the art continues to well receive new ideas.

BRIEF DESCRIPTION

A sand control sleeve includes a body; a port extending through the body; and a filtration material disposed relative the port and configured to attain a first condition where relatively less of the port is occupied and a second condition where relatively more of the port is occupied by the material.

A sand control sleeve including a body; a channel within the body; an opening from an inside diameter of the body to the channel; an opening from an outside diameter of the body to the channel; and a filtration material disposed to attain a first condition where relatively less of the channel is occupied and a second condition where relatively more of the channel is occupied.

A borehole treatment system includes a sand control sleeve disposed in a borehole; a pathway through the sand control sleeve; and a filtration material in operable communication with the pathway, the filtration material configured to attain a first condition where relatively less of the pathway is occupied and a second condition where relatively more of the pathway is occupied A method for producing fluid from a formation includes injecting fluid through a pathway in a sleeve without filtration; producing fluid from the formation with filtration through the same pathway.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figures 1, 2, 3:
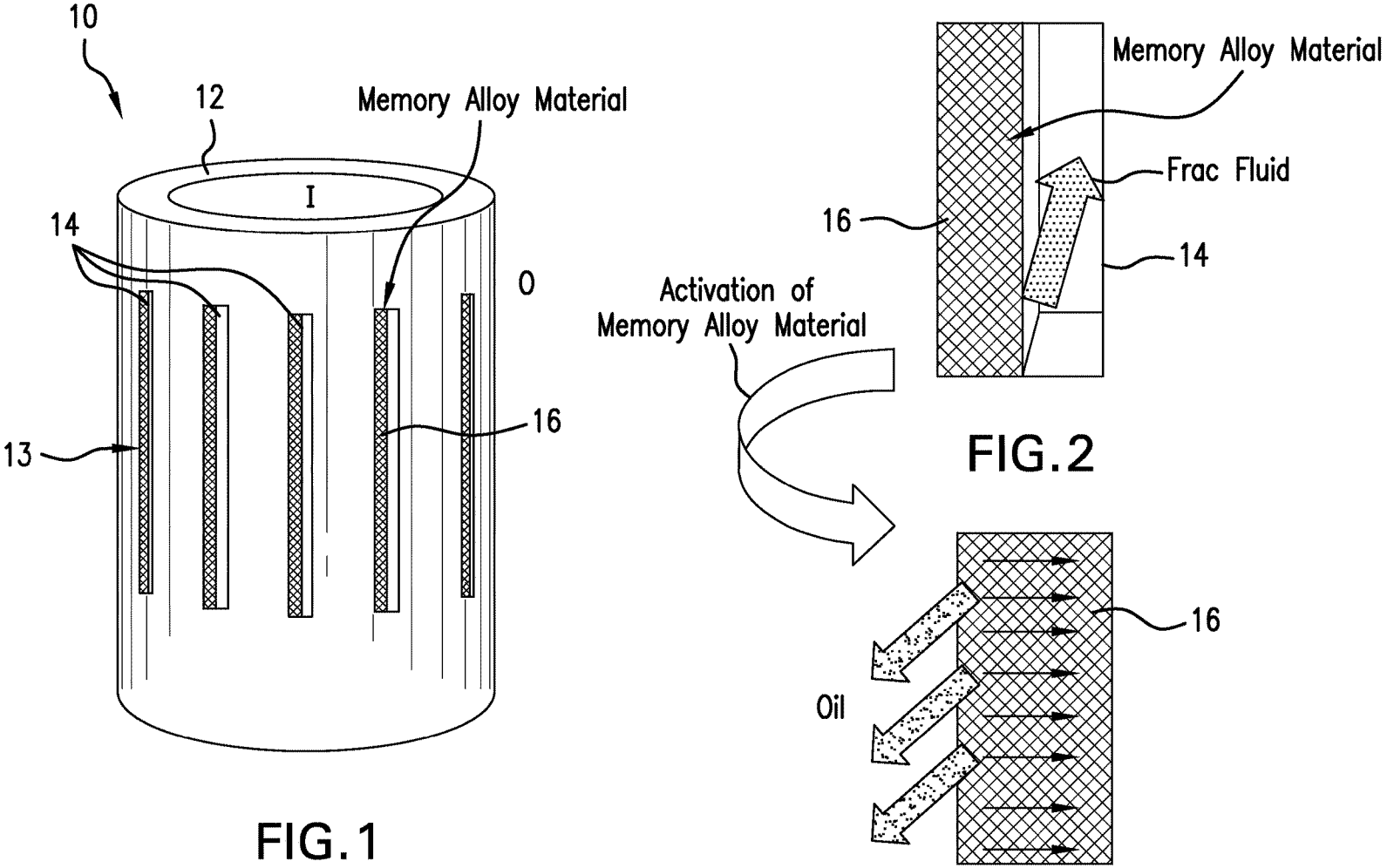
FIG. 1 is a schematic illustration of one embodiment of a sand control sleeve as disclosed herein.
FIG. 2 is an enlarged view of a port of FIG. 1 in an unactuated condition.
FIG. 3 is the view of FIG. 2 in an actuated condition.
Figure 5:
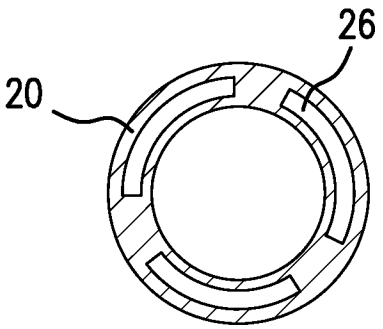
FIG. 5 is a cross section view of FIG. 4 taken along line 5-5.
Figure 4:
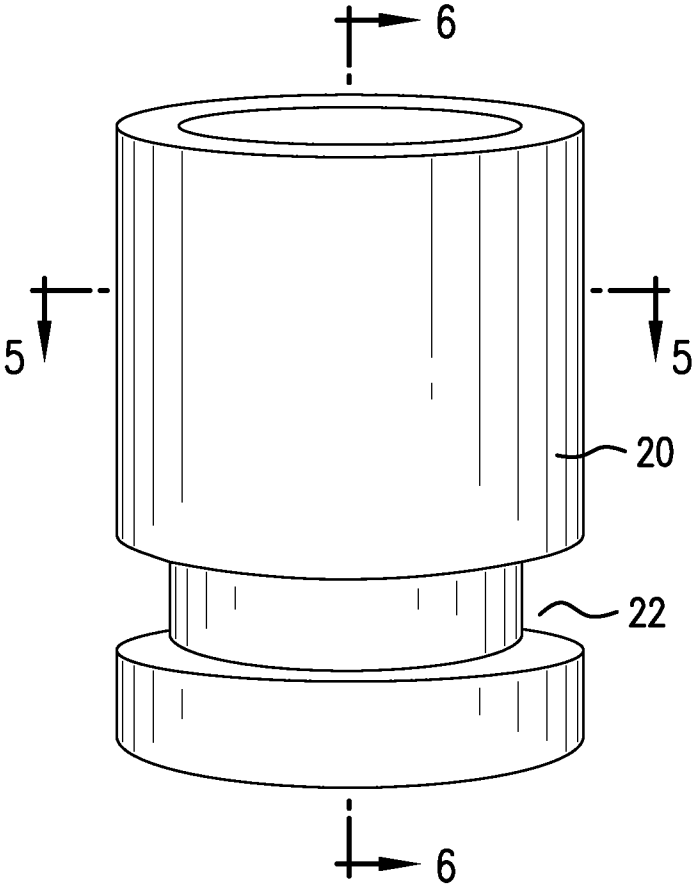
FIG. 4 is a schematic view of an alternate embodiment of a sand control sleeve as disclosed herein.

Referring to FIG. 1, Sand control sleeve 10 includes a body 12 and one or more pathways 13 through the body, here illustrated as ports 14. The ports may be of a number of distinct geometries including elongated slots as illustrated. The ports 14 extend through the body 12 hence allowing for fluid movement radially through the body at any time that a pressure outside of the body 12 (O) is distinct from a pressure inside of the body (I). Further included in operable communication with one or more of the one of more ports 14 is a filtration material 16 that is employed for sand control. In an embodiment the filtration material 16 is disposed within the port. The filtration material 16 employed is capable of attaining a first condition where relatively less of the port 14 is occupied including fully open and a second actuated condition where relatively more of the port is occupied including fully closed. Materials that can attain the described conditions may be employed to provide for an incremental filtering occlusion of the port(s) such that multiple different degrees of occupation of the port or pathway can be achieved by selection of filtration material and dimensions thereof. Materials contemplated in this regard include shape memory materials (alloys and polymers), and other materials that may occupy a smaller volume in some conditions and a larger volume in other conditions and provide for filtration. Particular materials include but are not limited to alloys such as nickel titanium alloy, nickel titanium zirconium alloy, titanium nickel copper alloy, copper aluminum manganese alloy, iron nickel cobalt aluminum tantalum boron alloy, copper aluminum niobium alloy, nickel manganese gallium alloy, zirconium copper alloy, polycrystalline iron nickel cobalt aluminum alloy, polycrystalline iron manganese aluminum nickel alloy, and polycrystalline nickel titanium zirconium niobium alloy and polymers such as sulfonated or carboxylated ionomers blended with low molecular weight additives having a range of actuation temperature of from 0° C. to 250° C. (up to 480 F), PTFE with an actuation temperature >600 F, polyurethanes, crosslinked polyolefins, polycaprolactones, PEO-PET block-copolymers, PET, AA/MAA copolymers, PEEK, PLA, etc. As will be understood by one of skill in the art, shape memory polymers can be activated by heat, electric or magnetic fields, certain fluids or combinations including at least one of the foregoing. Actuation by magnetic or electric field often requires the presence of conductive or magnetic fillers and is based on either Joule heating or induction heating mechanisms.

Referring to FIG. 2, in the condition where the filtration material does not occlude the one or more ports, the sand control sleeve 10 advantageously facilitates the passage of treatment fluid (for example, fracturing fluid, acid, etc.) in an unoccluded way to maximize the effect of the treatment operation while promoting sand control thereafter.

Subsequent to a treatment operation, and referring to FIG. 3, the filtration material 16 is caused to assume a condition that at least partially occupies one or more of the one or more ports 14. This may be triggered by temperature or by a particular chemistry to which the filtration material has been exposed either naturally or by injection. In either event, the filtration material becomes a barrier to sand and other fines that might otherwise be produced from the formation in which the sand control sleeve 10 is configured to be installed. This inhibition of sand and fines, will ensure a better produced fluid product.

Figures 6, 7:
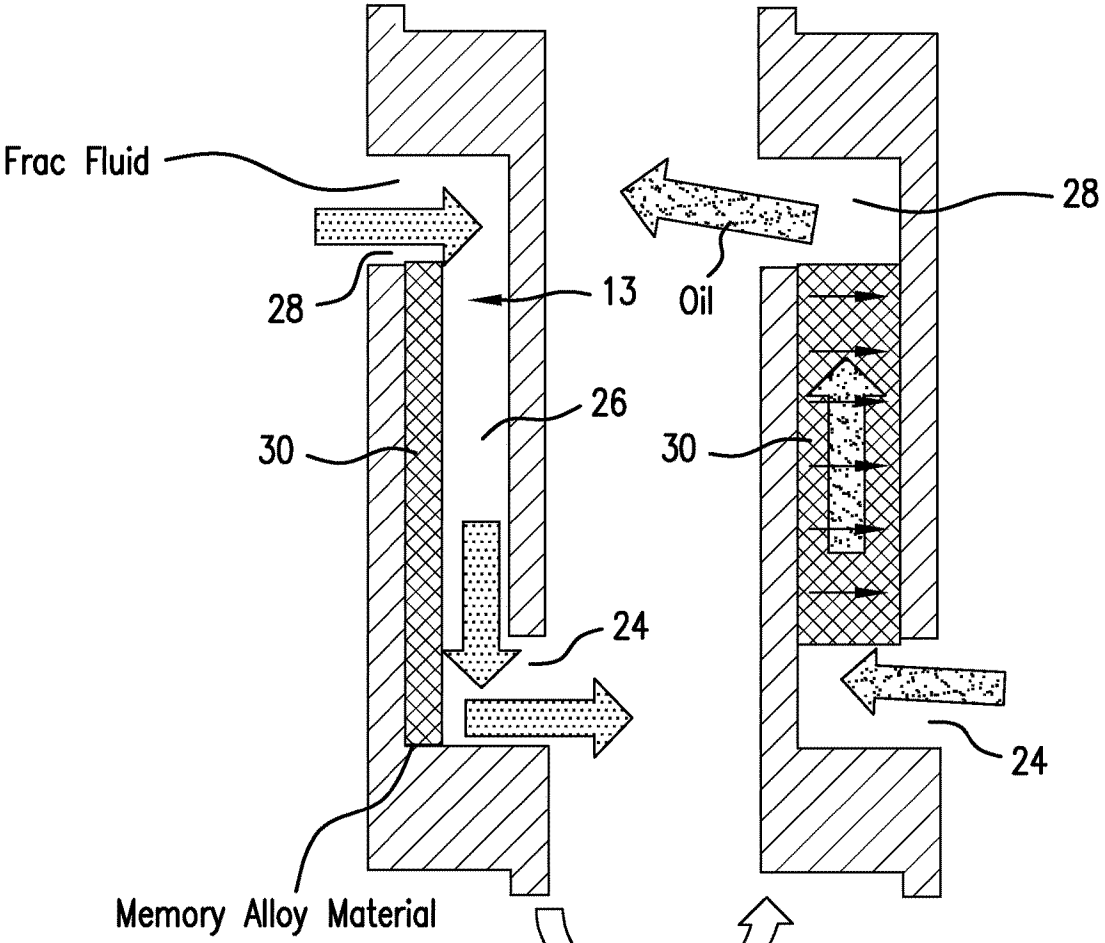
FIG. 6 is a cross sectional view of FIG. 4 taken along line 6-6 in an unactuated condition.
FIG. 7 is the view of FIG. 6 in an actuated condition.

In another embodiment, referring to FIGS. 4-7, a body 20 has a recess 22 that may be annular as illustrated or may be only part annular and may comprise several part annular sections. The recess 22 functions as an outside diameter opening 24 of a longitudinal channel 26 extending through the body 20 to an inside opening 28. The opening 28 communicates the channel 26 with the inside diameter volume of the tubular body 20 and the outside diameter opening 24 communicates the channel 26 with a volume outside of the body 20, which in an embodiment is a subterranean formation. The opening 24, channel 26 and opening 28 together constitute a pathway 13. As in the above described embodiment, this embodiment includes a filtration material 30 that functions as does the material 16 discussed above. In this embodiment, the filtration material is disposed within the channel 26 in a first condition where relatively less of the channel 26 is occupied and a second actuated condition where relatively more of the channel is occupied. Again similar to the foregoing, the filtration material is presented in the first condition for a treatment operation and in a second condition when production of fluid from the formation is desired through the body 20. In the latter condition, sand and fines otherwise entrained in the produced fluid are filtered out and not produced with the balance of the fluid being produced. While it is to be understood that variations of the placement and particular amount of occlusion presented by the filtration material is contemplated, FIGS. 6 and 7 provide a schematic representation of two possible conditions of the filtration material relative to the channel 26 and body 20.

A method for producing fluid from a formation is also contemplated. The method includes injecting fluid through a pathway in a sleeve without filtration and producing fluid from the formation with filtration through the same pathway. This is effected as described above in that a filtration material is initially in a first condition where the pathway is relatively less occluded and can be actuated to a second condition wherein the pathway is relatively more occluded with the filtration material thereby enabling the sleeve to allow application of treatment fluid to the formation without filtration while allowing produced fluid from the formation to be filtered prior to entering a string in which the sleeve is positioned. Either of the illustrated embodiments may be employed or other embodiments that meet the criteria disclosed above may be employed. The formation may be a hydrocarbon bearing formation and the treatment may be for example and acidizing treatment or a fracturing treatment.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sand control sleeve comprising:
a body passable through a casing of a wellbore;
a port extending through the body; and
a filtration material disposed in the port and configured to attain a first condition where relatively less of the port is occupied permitting fluid flow through the port without filtration and a second condition where relatively more of the port is occupied by the material preventing fluid flow through the port without filtration.

2. The sand control sleeve as claimed in claim 1 wherein filtration material is a shape memory material.

3. The sand control sleeve as claimed in claim 2 wherein the shape memory material is an alloy.

4. The sand control sleeve as claimed in claim 2 wherein the shape memory material is a polymer.

5. The sand control sleeve as claimed in claim 1 wherein the filtration material is disposed within the port in both the first and second conditions.

6. The sand control sleeve as claimed in claim 1 wherein the filtration material is configured to attain multiple different degrees of occupation of the port.

7. The sand control sleeve as claimed in claim 1 wherein the first condition leaves the port substantially fully open.

8. The sand control sleeve as claimed in claim 1 wherein the second condition leaves the port completely occluded with filtration material.

9. The sand control sleeve as claimed in claim 1 wherein the port is a slot.

10. A sand control sleeve comprising:
a body passable through a casing of a wellbore;
a channel within the body;
an opening from an inside diameter of the body to the channel;
an opening from an outside diameter of the body to the channel; and
a filtration material disposed to attain a first condition where relatively less of the channel is occupied permitting fluid flow through the port without filtration and a second condition where relatively more of the channel is occupied preventing fluid flow through the port without filtration.

11. The sand control sleeve as claimed in claim 10 wherein the filtration material is a shape memory material.

12. A borehole treatment system comprising:
a sand control sleeve passable through a casing of a wellbore disposed in a borehole;
a pathway through the sand control sleeve; and
a filtration material in operable communication with the pathway, the filtration material configured to attain a first condition where relatively less of the pathway is occupied permitting fluid flow through the port without filtration and a second condition where relatively more of the pathway is occupied preventing fluid flow through the poort without filtration.

13. The sand control sleeve as claimed in claim 12 wherein the filtration material is a shape memory material.

14. A method for producing fluid from a formation comprising:
injecting fluid through a port in a sleeve without filtration;

producing fluid from the formation through a filtration material disposed in the same port.

15. The method as claimed in claim 14 wherein the method further includes fracturing the formation.

16. The method as claimed in claim 14 wherein the producing includes actuating a filtration material from a first condition to a second condition.

* * * * *